US005585902A

United States Patent [19]

Nishiuwatoko et al.

[11] Patent Number: 5,585,902

[45] Date of Patent: Dec. 17, 1996

[54] TONER CARTRIDGE, PROCESS CARTRIDGE AND ELECTROPHOTOGRAPHIC IMAGE FORMING APPARATUS

[75] Inventors: Tsutomu Nishiuwatoko, Tokyo; Kazuyoshi Odagawa, Koshigaya; Hiroo Kobayashi, Yokohama; Shinichi Sasaki, Fujisawa, all of Japan

[73] Assignee: Canon Kabushiki Kaisha, Tokyo, Japan

[21] Appl. No.: 399,648

[22] Filed: Mar. 7, 1995

[30] Foreign Application Priority Data

| | | | |
|---|---|---|---|
| Mar. 8, 1994 | [JP] | Japan | 6-036991 |
| Feb. 24, 1995 | [JP] | Japan | 7-036943 |

[51] Int. Cl.[6] ..... G03G 15/06

[52] U.S. Cl. ..... 355/260; 355/210

[58] Field of Search ..... 355/200, 210, 355/245, 260; 222/DIG. 1

[56] References Cited

U.S. PATENT DOCUMENTS

| | | | |
|---|---|---|---|
| 4,462,680 | 7/1984 | Ikeda . | |
| 4,930,684 | 6/1990 | Patterson . | |
| 4,931,838 | 6/1990 | Ban et al. | 355/260 |
| 4,961,450 | 10/1990 | Furuta . | |
| 5,134,441 | 7/1992 | Nagata et al. | 355/245 |
| 5,150,807 | 9/1992 | Seyfried et al. | 355/260 X |
| 5,206,619 | 4/1993 | Kita | 355/260 |
| 5,223,893 | 6/1993 | Ikemoto et al. | 355/200 |
| 5,229,824 | 7/1993 | Tsusaka et al. | 355/260 |
| 5,258,814 | 11/1993 | Davies | 355/260 |
| 5,294,960 | 3/1994 | Nomura et al. | 355/210 |
| 5,370,761 | 12/1994 | Chitouras | 355/260 X |

FOREIGN PATENT DOCUMENTS

| | | |
|---|---|---|
| 0632342 | 1/1995 | European Pat. Off. . |
| 4293066 | 10/1992 | Japan . |

OTHER PUBLICATIONS

Patent Abstracts of Japan, vol. 017, No. 098, p. 1494, Feb. 26, 1993.

*Primary Examiner*—Sandra L. Brase

*Attorney, Agent, or Firm*—Fitzpatrick, Cella, Harper & Scinto

[57] ABSTRACT

A process cartridge detachably mountable to a main assembly of an image forming apparatus includes an electrophotographic photosensitive member; a process device actable on the photosensitive member; a toner container for containing toner for developing a latent image formed on the electrophotographic photosensitive member, the toner container having an opening for permitting supply of the toner to a developing portion therefrom; a sealing member for sealing the opening; and a seal mounting portion for permitting a sealing member a plurality of times.

27 Claims, 9 Drawing Sheets

TONER CARTRIDGE, PROCESS CARTRIDGE AND ELECTROPHOTOGRAPHIC IMAGE FORMING APPARATUS

FIELD OF THE INVENTION AND RELATED ART

The present invention relates to a toner cartridge for containing toner usable with an electrophotographic image forming apparatus, a process cartridge detachably mountable to the image forming apparatus, and an electrophotographic image forming apparatus using the process cartridge.

Here, the electrophotographic image forming apparatus means an apparatus for forming images on a recording material through an electrophotographic image formation process, such as an electrophotographic copying machine, an electrophotographic printer, an electrophotographic facsimile machine or the like.

The process cartridge is a unified cartridge containing an electrophotographic photosensitive member and charging means, developing means for cleaning means, which is detachably mountable as a unit relative to the main assembly of image forming apparatus. Therefore, it contains as a unit an electrophotographic photosensitive member and at least one of charging means, developing means and cleaning means. In another example of the process cartridge, it contains the developing means and the electrophotographic photosensitive member.

The toner cartridge is for supplying the toner into the image forming apparatus when the toner therein is consumed.

In the electrophotographic image forming apparatus, the electrophotographic photosensitive member is uniformly charged by charging means and is exposed to imagewise light in accordance with image information, by which a latent image is formed on the electrophotographic photosensitive member. The latent image is developed by developing means. Thereafter, the toner image formed by the developing means is transferred onto a recording material, thus forming an image on the recording material. In such an electrophotographic image forming apparatus, it is usual that an expert surface person carries out the maintenance operation. To avoid this, a detachably mountable process cartridge is used. By the user exchanging the process cartridge, the maintenance of the apparatus is made much easier. The process cartridge type apparatus has been put into practice. Recently, reuse of parts is considered and started.

The present invention provides a further development of the process cartridge. In addition, the present invention is applicable not only to the process cartridge but also to a toner cartridge for containing toner.

SUMMARY OF THE INVENTION

Accordingly, it is a principal object of the present invention to provide a toner cartridge, process cartridge and an electrophotographic image forming apparatus with which recycling of materials is easy.

It is another object of the present invention to provide a toner cartridge, process cartridge and an electrophotographic image forming apparatus in which the toner is prevented from leaking from the cartridge frame after the recycling thereof.

It is a further object of the present invention to provide a toner cartridge, a process cartridge and an electrophotographic image forming apparatus in which sealing members can be repeatedly mounted.

It is a further object of the present invention to provide a toner cartridge, a process cartridge and an electrophotographic image forming apparatus having a seal mounting portion capable of permitting an opening of a toner container to be sealed a plurality of times.

It is yet further object of the present invention to provide a toner cartridge, a process cartridge and an electrophotographic image forming apparatus in which after a sealing member is removed from a container opening, a fresh sealing member can be mounted to the same opening.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiments of the present invention will be described in detail.

Embodiment 1

Referring to FIGS. 1–6, the description will be made as to a process cartridge, as an example, according to Embodiment 1 of the present invention.

Figure 1:
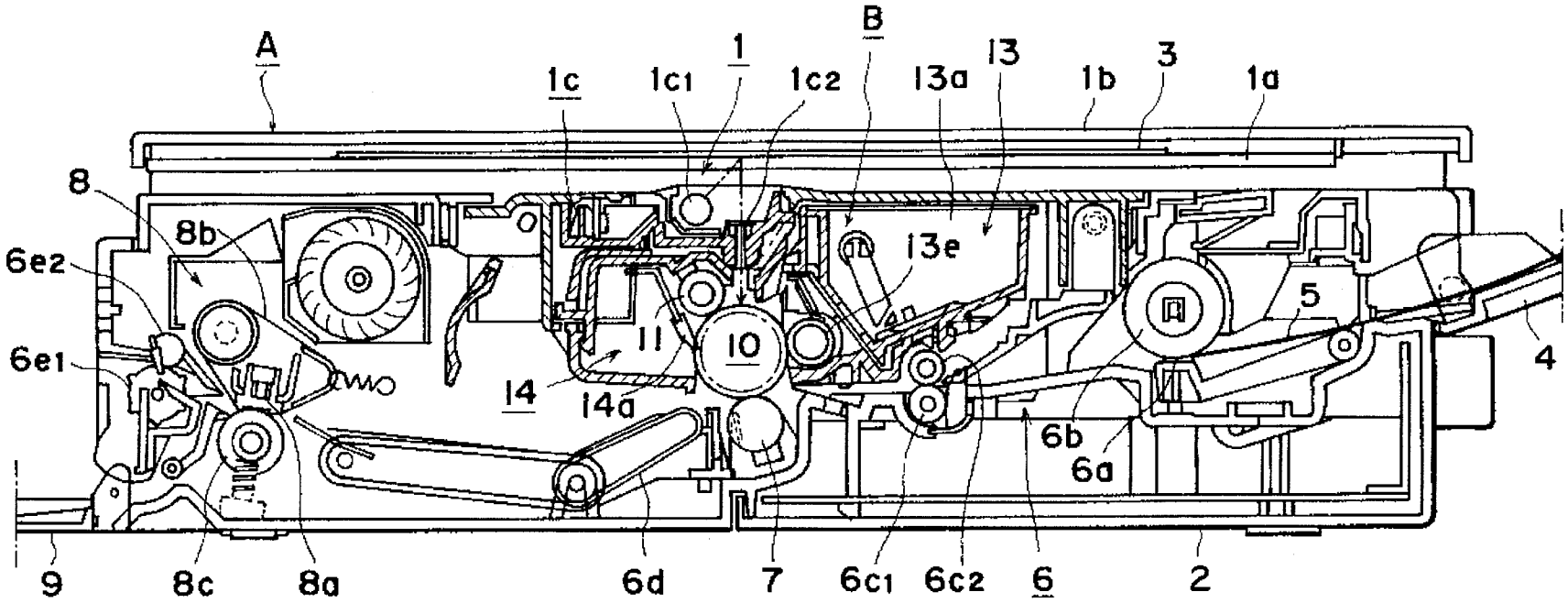
FIG. 1 is a sectional view of an image forming apparatus loaded with a process cartridge, according to an embodiment of the present invention.
Figure 2:
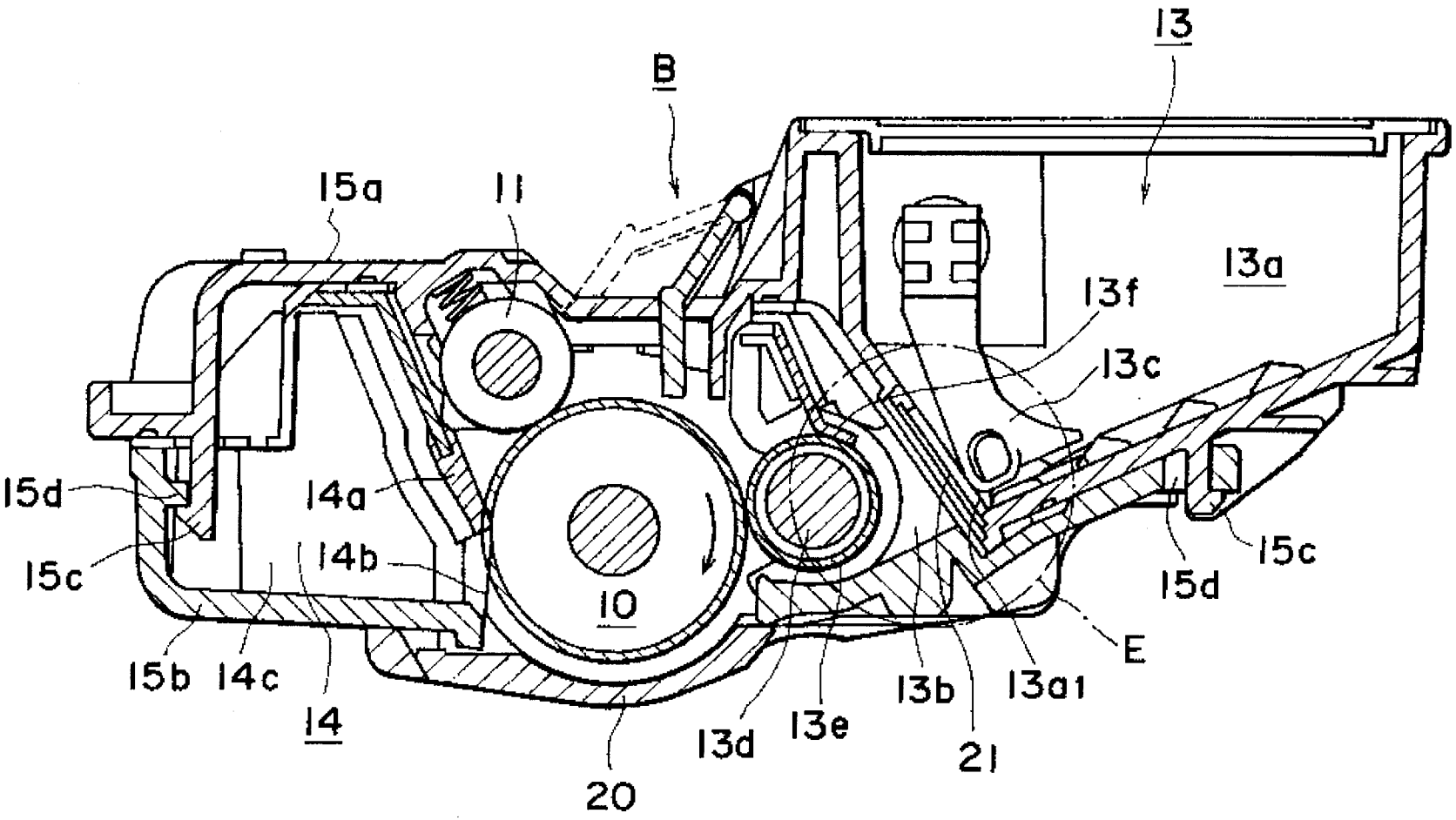
FIG. 2 is a sectional view of a process cartridge shown in FIG. 1.
Figure 3:
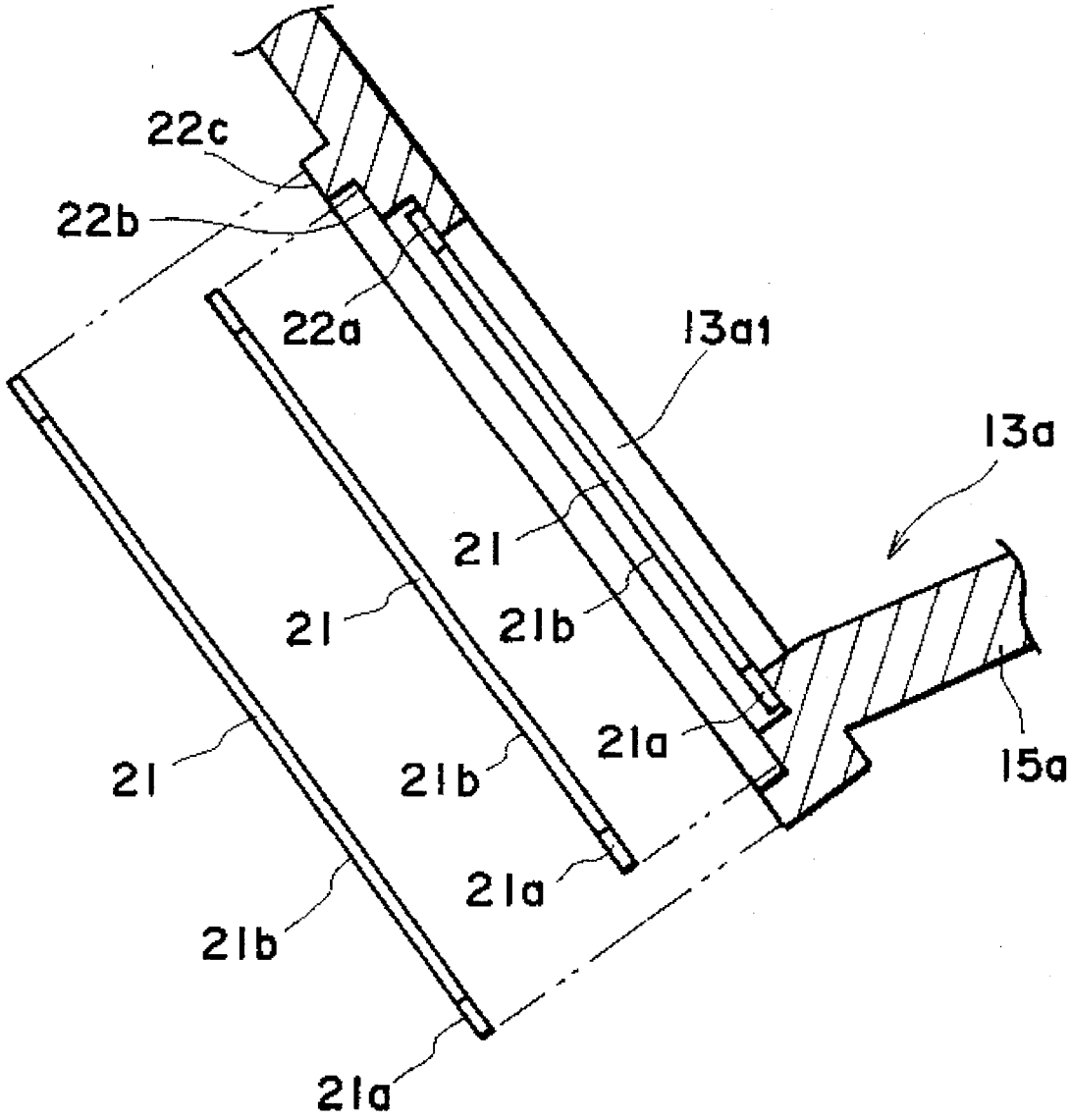
FIG. 3 illustrates a sealing structure in which an opening edge of a container for containing toner in the process cartridge is formed into steps.
Figure 4:
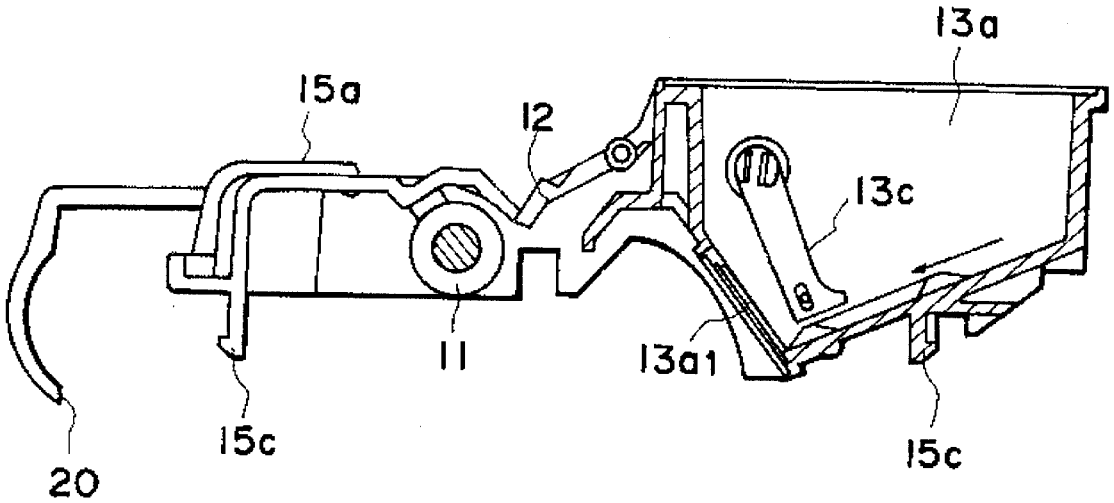
FIG. 4 is a sectional view in which the process cartridge of FIG. 1 partly disassembled.
Figure 4:
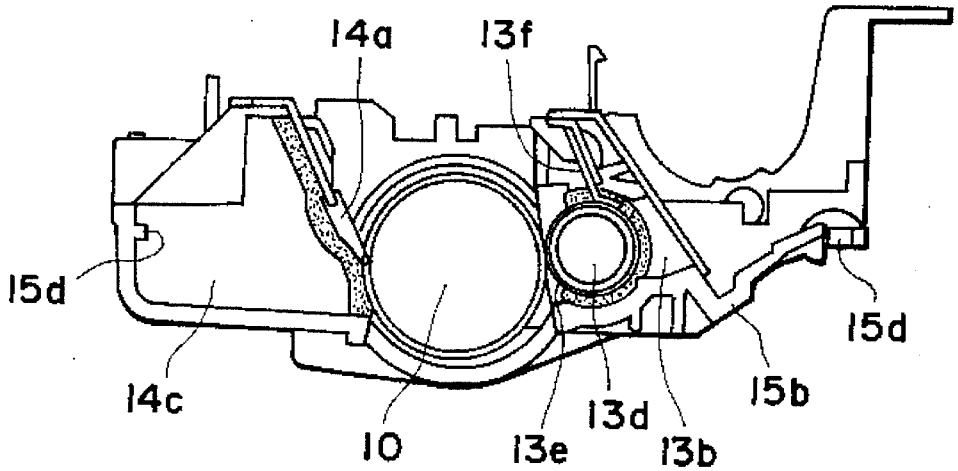

FIG. 1 is a sectional view of an electrophotographic image forming apparatus to which a process cartridge is detachably mountable. FIG. 2 is a sectional view of a process cartridge used in the apparatus of FIG. 1. FIG. 3 illustrates the sealing structure for the toner container in the process cartridge of FIG. 1. In FIG. 4, the process cartridge of FIG. 1 is shown in a disassembled state.

Figure 5:
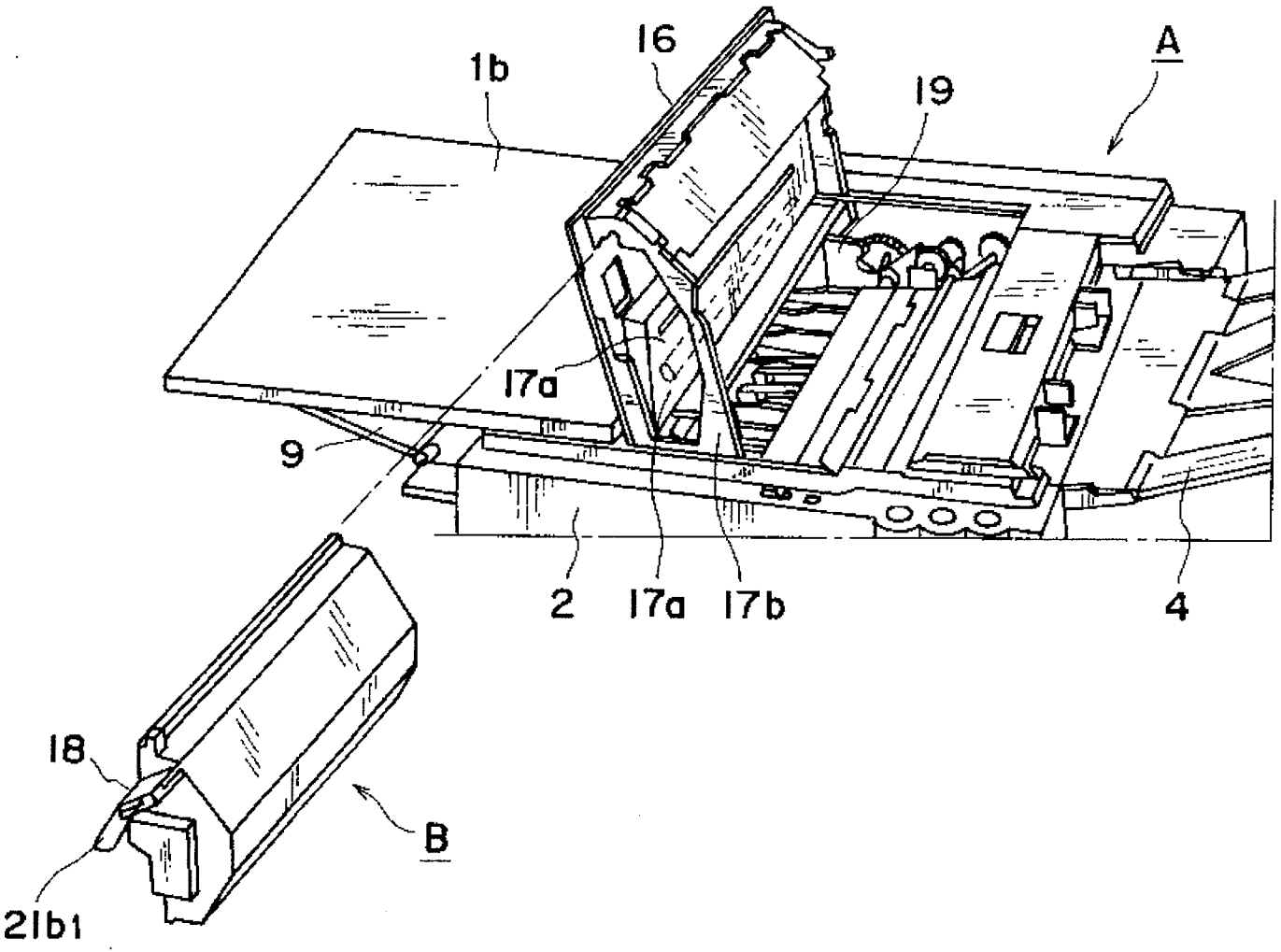
FIG. 5 is a perspective view illustrating mounting operation of the process cartridge of FIG. 1.
Figure 6:
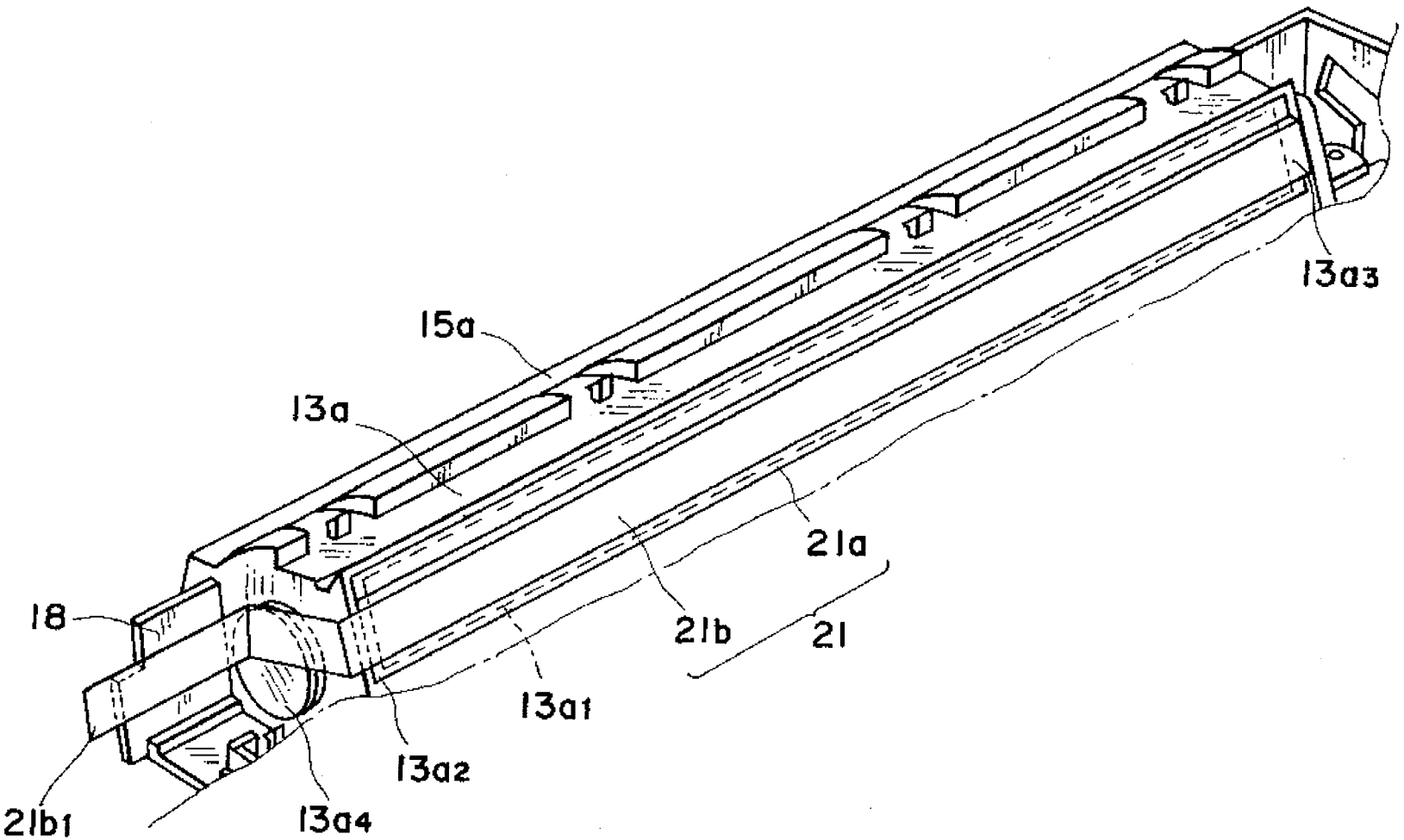
FIG. 6 is a perspective view of a toner container provided in the process cartridge of FIG. 1.
Figure 10:
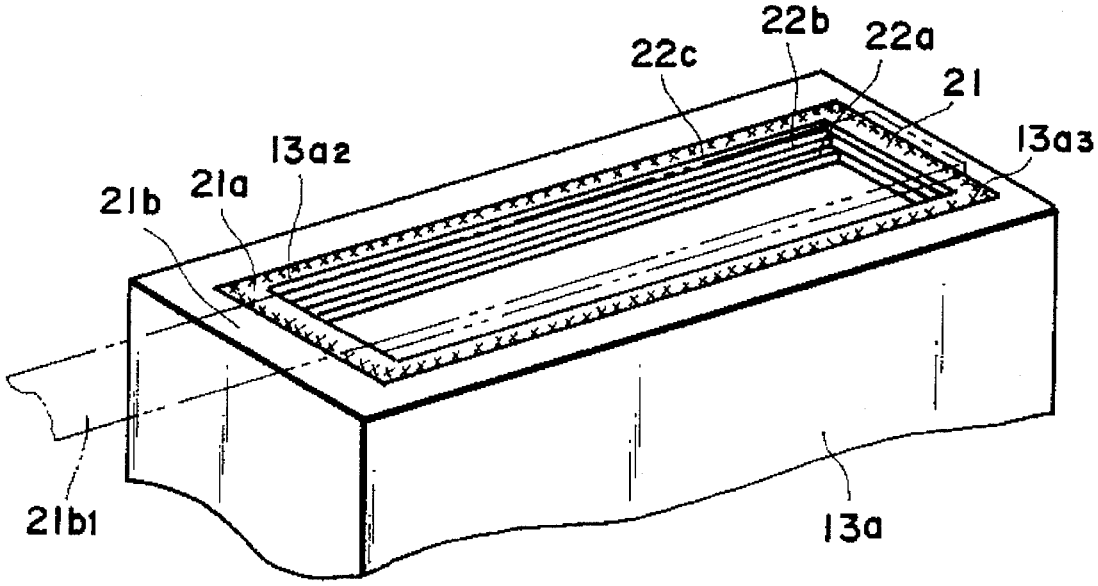
FIG. 10 is a schematic perspective view of an opening of the toner container in the process cartridge of FIG. 1.

FIG. 5 illustrates the mounting of the process cartridge in the main assembly. FIG. 6 shows an outer appearance of the toner container in the process cartridge of FIG. 1. FIG. 10 schematically shows the opening of the toner container in the process cartridge of FIG. 1.

The description will first be made as to the general arrangement of the image forming apparatus referring to FIGS. 1–5, and the description will be made as to the sealing structure for the toner container referring to FIGS. 3 and 10.

General arrangement

The electrophotographic image forming apparatus A, as shown in FIG. 1, using an electrophotographic image forming process, images are formed on a recording material such as a recording sheet of paper, textile, OHP sheet or the like.

First, an original reading means 1 has an original supporting glass 1*a* for supporting an original thereon at the top of the main assembly 2 of the apparatus. An original cover 1*b* is rotatably mounted covering the original glass 1*a*. The original supporting glass 1*a* and the original cover 1*b* are slidable relative to the main assembly 2 in a horizontal direction in FIG. 1 (x direction). On the other hand, at an upper portion of the main assembly 2 and below the original supporting glass 1*a*, there is provided a lens unit 1*c*, including a light source 1*c*1, a short focus imaging lens array 1*c*2. The original is placed on the original supporting glass 1*a* face down on the original supporting surface thereof, and the light source 1*c*1 is turned on. Then, the original supporting glass 1*a* is moved in the direction X. The light reflected from the original 3 is projected onto an electrophotographic photosensitive member in the form of a drum (photosensitive drum) of a process cartridge B through the lens array 1*c*2.

In synchronism with the exposure to the original image light, a recording material 5 contained in a sheet feeding tray 4 is fed out by cooperation of a separation pad 6*a* and a separation roller 6*c* press-contacted thereto and fed forward by feeding means including registration rollers 6*c*1 and 6*c*2. The toner image formed on the photosensitive drum 10 in the process cartridge B is transferred onto the recording material by application of a voltage to the transfer roller 7 functioning as a transfer means. Then, the recording material 5 is fed to an image fixing means 8 comprising a heater 8*a*, a fixing rotatable member 8*b*, and a driving roller press-contacted to the rotatable member 8*b*. By passing the recording material through the nip formed between the rotatable member 8*b* and the driving roller 8*c*, the transferred toner image is fixed on the recording material 5. The recording material 5 is fed by a pair of discharging rollers 6*e*1 and 6*e*2 onto a discharge tray 9.

On the other hand, the process cartridge B, as shown in FIG. 2, contains a rotatable photosensitive drum 10 having a photosensitive layer. During the rotation thereof, the surface of the photosensitive member is uniformly charged by a charging roller 11 (charging means). The photosensitive drum 10 is exposed to the light reflected by the original and from the reading means 1 through an exposure opening 12, so that a latent image is formed thereon. The latent image is developed by developing means 13 into a toner image.

The developing device 13 comprises a toner container 13*a* for containing toner, a developing portion 13*b* for forming the toner image on the photosensitive drum 10, wherein the toner is fed from the toner container 13 into a developing zone 13 by a toner feeding member 13*c*. The developing roller 13*e* containing a stationary magnet 13*d* in the developing portion 13*b* is rotated, a layer of the toner supplied with a triboelectric charge by developing blade 13*f* is formed on the developing roller 13*e*. The toner is supplied to the photosensitive drum 10 to develop the latent image thereon into a toner image.

The transfer roller 7 is supplied with a voltage having a polarity opposite from that of the toner, so that the toner image is transferred from the photosensitive drum 10 onto the recording material 5. The residual toner remaining on the photosensitive drum 10 is scraped off by an elastic cleaning blade 14*a*. The toner scraped off by the blade 14*a* is received by a receiving sheet 14*b*, and is collected into a residual toner container 14*c*. In this manner, the residual toner on the photosensitive drum 10 is removed by the cleaning device. The cleaning device 14 is constituted by the blade 14*a*, the receiving sheet 14*b* and the residual toner container 14*c*.

As shown in FIG. 4, the charging roller 11, the exposure opening 12, a toner container 13*a* for containing the toner is provided in a top frame 15*a*, and the photosensitive drum 13, the developing portion 13*b* of the developing device 13 and the cleaning device are provided in the bottom frame 15*b*. The process cartridge B is constituted by connecting the top and bottom frames 15*a* and 15*b*. The top frame 15*a* and the bottom frame 15*b* are separably engaged by resiliently engaging the claws 15*c* of the top frame 15*a* with engaging portions 15*d* of the bottom frame.

The process cartridge B is detachably mounted to a cartridge mounting means 17 of the main assembly. As shown in FIG. 5, an openable cover 16 is provided on the top of the apparatus main assembly 2. The cover 16 is provided with a mounting member 17*b* having an engaging window 17*a* in conformity with the configuration of the process cartridge B. Upon the mounting of the process cartridge B, the operator manipulates the process cartridge B using the grip 18 into the window 17*a*, and the cover 16 is then closed. By doing so, a shaft (not shown) of the photosensitive drum 10 projected from the frames 15*a* and 15*b* of the process cartridge B and a shaft (not shown) of the developing sleeve 13*e* is supported on a shaft supporting member 19 of the main assembly 2. At this time, a protection cover 20 protecting the photosensitive drum 10 of the process cartridge B (FIG. 2) is rotated by an unshown mechanism to expose an image transfer region of the photosensitive drum 10 to bring the transfer roller 7 into contact with the drum 10, so that the mounting of the cartridge B is completed.

Sealing structure

When the process cartridge B is mounted in place in the main assembly A, the developing device 13 receives the toner from the toner container 13*a* into the developing portion 13*b*. However, in the case of fresh (non-used) process cartridge B, the opening 13*a*1 of the toner container 13*a* is sealed by a sealing member 21 to prevent moisture absorption and scattering of the toner particles during transportation or in storage. The sealing structure will be described.

As shown in FIG. 6, the opening 13*a*1 of the toner container 13*a* is sealed by sticking a sealing member 21 to cover the opening 13*a*1 for supplying the toner to the developing portion 13*b*. The sealing member 21 comprises a cover film 21*a* of uniaxial oriented polyethylene film or uniaxial oriented polypropylene film or the like and a flexible tear tape 21*b* of bi-axial oriented polyester film and bi-axial oriented polypropylene film or the like, which is integrally bonded thereto. In this embodiment, the bonding between the cover film 21*a* and the tear tape 21*b*, and the bonding between the cover film 21*a* and the edge of the container 13*a* defining the opening 13*a*1, are both effected by heat fusing. They may be effected by bonding material.

The tear tape 21*b*, as shown in FIG. 6, extends from one longitudinal end 13*a*2 of the opening 13*a*1 (left hand end in FIG. 6) to the other end 13*a*3 (right hand end in FIG. 6). The tape 21*b* is folded back at the end 13*a*3, and is extended along the group 18*b* formed at a side end of the top frame 15*a* and is projected out of the process cartridge B. The tear tape 21*b*, prior to the mounting of the process cartridge B into the image forming apparatus A by the operator, the projection 21*b*1 is pulled out, by which the cover film 21*a* is torn along the tear tape 21*b*, thus open the opening 13*a*1. The toner contained in the toner container 13*a* is permitted to be fed to the developing zone 13*b*. In FIG. 6, a toner filling port 13*a*4 functions to supply the toner into the container 13*a*, after the opening 13*a*1 sealed by the sealing member 21.

Referring to FIG. 3, the description will be made as to the edge of the opening 13*a*1 of the toner container 13*a* sealed by the sealing member 21. FIG. 3 is an enlarged view of a part E of the process cartridge B in FIG. 2.

As shown in FIG. 3, the edge of the opening 13*a*1 of the toner container 13*a*, is provided with three sealing surfaces 22*a*, 22*b* and 22*c* in the form of steps, that is, having different levels. More particularly, the edge portion of the opening has a first sealing surface 22*a*, a second sealing surface 22*b* one step above and outside thereof, and a third sealing surface 22*c* further higher by one step, and further outside thereof. The sealing surfaces 22*a*, 22*b* and 22*c* can be sealed by sealing members 21 having corresponding size. The sealing members 21 can be fused on the sealing surfaces 22*a*, 22*b* and 22*c* constituting flat steps.

In the initial assembling of the process cartridge B, the sealing member 21 is fused on the first sealing surface 22*a* to seal the opening 13*a*1, and it is delivered out. The process cartridge B is intended to be collected after use and to be reused.

The recycling steps will be described briefly. The used process cartridges B are collected back in corporation with users and service persons or the like. They are transported to a recycling plant, where the cartridge B is disassembled, and various parts are taken out. The parts are inspected, and are classified into reusable parts and parts not to be reused because of damages or service lives. Only the reusable parts are cleaned by air gun or the like, to permit reuse thereof. Further inspections are carried out, and satisfactory parts are further inspected as to whether the functions thereof are satisfactorily refreshed or not. Only the parts passing through the inspections are used to produce recycled process cartridge.

Upon the initial use of the process cartridge B in which the operator removes the sealing member 21 sealing the opening 13*a*1 on the first sealing surface 22*a*, a part of the cover film 21*a* remains on the first sealing surface 22*a*. In order to fuse again on the sealing surface 22*a*, the remaining film has to be completely removed, and this operation is cumbersome.

Therefore, when the process cartridge B is recycled, the first sealing surface 22*a* is not used in the second assembling, but the sealing member 21 is fused on the second sealing surface 22*b* to seal the opening 13*a*1.

Furthermore, for the third use, the first and second sealing surfaces 22*a* and 22*b* are not used, but the sealing member 21 is fused on the third sealing surface 22*c* to seal the opening 13*a*1.

Thus, in this embodiment, three sealing surfaces are prepared for mounting the sealing member 21 so as to permit the opening 13*a*1 to be sealed three times without the necessity for removing the rest of the tape on the sealing surface. Therefore, the recycling of the top frame 15*a* is made easy.

The top frame 15*a* and the bottom frame 15*b* are of plastic material such as high impact styrene material, and if they are used for a long term, damage, deformation, deterioration or the like occurs. For this reason, in this embodiment, when they exceeds to use limit, they are crushed and reused as blank material. As an indication for this discrimination, it is desirable that how many times the top frame 15*a* is used is known.

According to this embodiment, by predetermining the order of fusing of the sealing members 21 and sealing surfaces 22*a*, 22*b* and 22*c*, the number of use can be readily known. For example, it may be predetermined as described hereinbefore that the first sealing surface 22*a* is used for the first assembling, the second sealing surface 22*b* is used for the second assembling, and the third sealing surface 22*c* is used for the third assembling. By doing so, the number of past uses can be easily discriminated by checking the existence of the remaining cover film 21*a* on the sealing surfaces, upon the recycling.

In order to made the discrimination further easier, the sealing member 21 may be provided with a mark or a sign indicative of the number of uses, or the configuration and/or the color thereof may be made different. By doing so, the recycling operator can further easily discriminate the number of uses of the top frame 15*a*. This eliminates the necessity for particularly provision of marks or the like indicative of the number of uses for every reuse.

In the foregoing embodiment, the number of steps of the sealing portion is three two permit three sealings. However, the number is not limiting, and it may be determined by one skilled in the art properly in accordance with the limit number of uses for the top frame 15*a*.

By forming the sealing surface into a configuration for permitting repeated use for the sealing surface, the sealing member 21 can be easily mounted a plurality of times, thus permitting easy recycling of the frame.

Embodiment 2

Figure 7A:
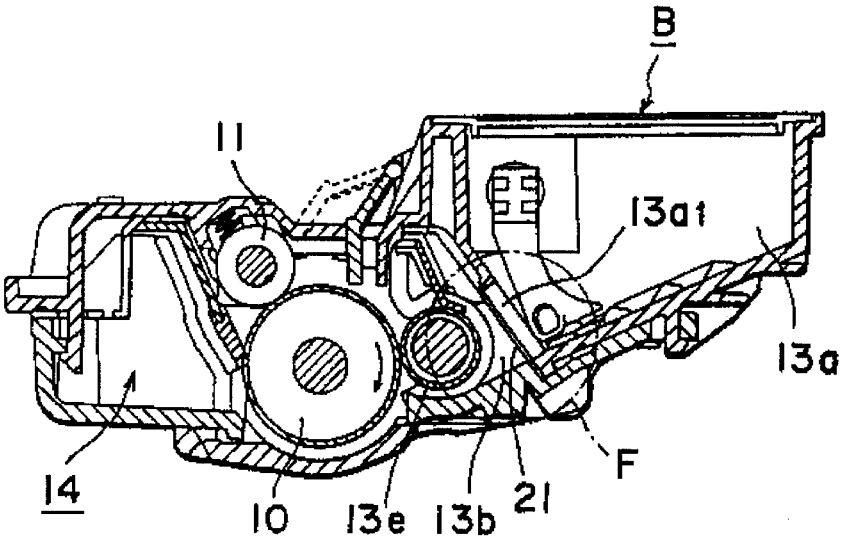
FIGS. 7(*a*) and 7(*b*) illustrate a process cartridge according to another embodiment of the present invention, in which an opening of a container for containing the toner in the process cartridge is expanded or reduced in accordance with the number of sealings.
Figure 7B:
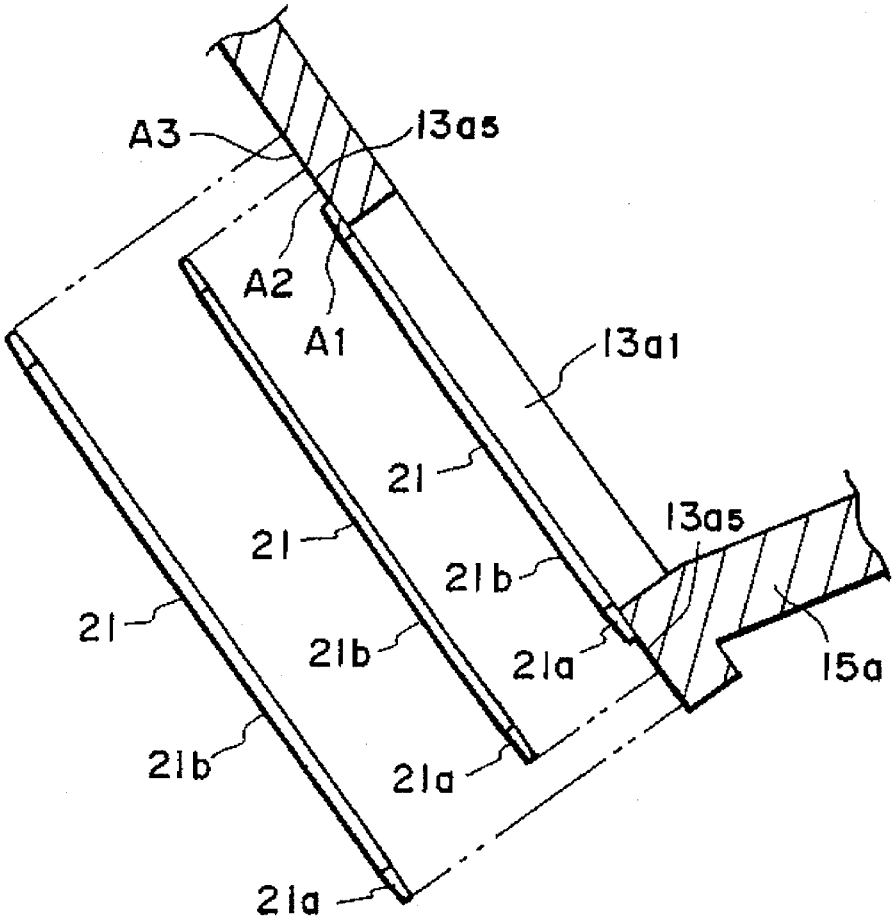

In the first embodiment, the edge portions of the toner container 13*a* is formed into steps to permit easy mounting of the sealing members 21 a plurality of times. FIGS. 7(*a*) and 7(*b*) show another embodiment in which the edge portion 13*a*5 is not stepped, but the fusing area of the seal is increased, decreased or made different depending on the number of uses. By doing so, the same advantageous effects as in Embodiment 1 can be provided.

In a first example, the sealing area for the sealing member 21 is made different. As shown in FIG. 7, upon the initial assembling of the toner container 13*a*, the sealing member 21 is fused on an area A1 along an outer edge of the opening 13*a*1. Upon the second assembling, the sealing member 21 is fused on an area A2 outside the area A1. Similarly, upon the third assembling, the sealing member 21 is fused on an area A3 outside of the area A2.

In a second example, the area for the fusing is increased, more particularly, the sealing member 21 is fused on both of the areas A1 and A2 upon the second assembling. Upon the third assembling, the sealing member 21 is fused on the areas A1, A2 and A3. In this case, one of the areas A1, A2 and A3, is free of the rest of the covering material, that is, fresh, and therefore, the bonding strength is high enough even if the sealing tape is mounted without removing the remaining material.

Embodiment 3

Figure 8A:
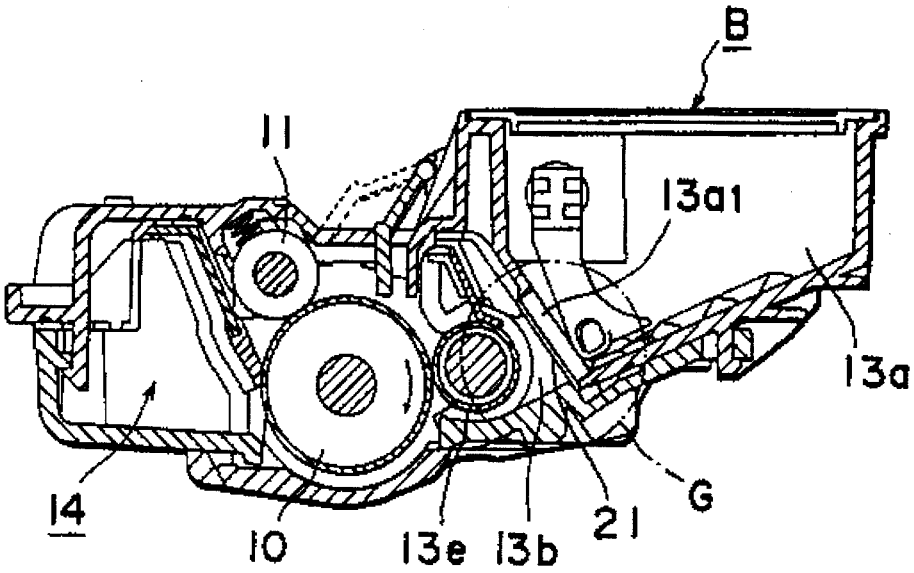
FIGS. 8(*a*) and 8(*b*) are sectional views of a process cartridge according to a further embodiment of the present invention in which an edge of the opening is formed into a rib.
Figure 8B:
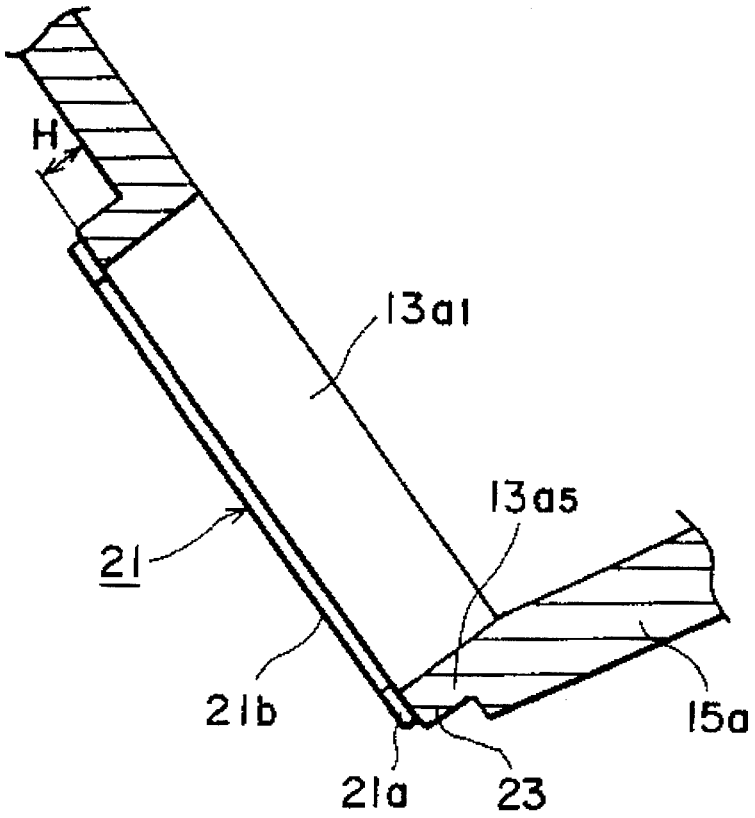

In Embodiment 1, the edge portion of the toner container 13*a* is formed into steps to permit mounting of the sealing member 21 a plurality of times. FIGS. 8(*a*) and 8(*b*) show a third embodiment, wherein (a) shows a general arrangement of the process cartridge B, (b) is an enlarged view of the portion G in (a).

In this embodiment, the edge portion 13*a*5 of the opening 13*a*1 of the toner container 13*a* is provided with a rib 23 having a height H as a sealing portion. The sealing member 21 is fused by heat on the rib 23. Upon the start of use of the process cartridge B, the operator removes the sealing member 21. Then, a part of the cover film 21*a* remains on the rib surface. However, upon the recycling, the rib 23 is cut or abraded by knife or fine sand paper or the like, and the sealing member 21 is fused on the thus refreshed surface of the rib. By removing a predetermined amount of the rib 23, the rib surface is refreshed so that it can be fused by the sealing member 21 without problem. Since the edge portion 13*a*5 is formed to be projected out of the top frame 15*a*, as in rib 23, the cutting operation is easy.

The amount of removal of the rib 23, is satisfactory if the fresh rib surface is exposed. The height H of the rib 23 is determined on the basis of the amount of removal and the number of reuse of the top frame 15*a*.

By providing numberings on the surface of the rib 23*a* depending on the thickness to be removed by one recycling, the number of the cuttings of the rib 23 can be easily discriminated, so that the number of uses of the top frame 15*a* can be easily discriminated.

As described above, with the structure of fusing the sealing member 21 on the rib 23, the recycling of the top frame 15*a* is easy as in Embodiment 1, and in addition, the size and configuration of the sealing member 21 may be one.

Embodiment 4

In Embodiments 1–3, the opening of the toner container 13*a* of the process cartridge to be mounted into the main assembly of the image forming apparatus, is sealed. However, the present invention is not limited to the process cartridge.

In an ordinary electrophotographic image forming apparatus such as a copying machine, the photosensitive drum, the charging device, the developing device, the cleaning device and the transfer device are directly mounted on the main assembly. In such a type, the toner is supplied from a toner hopper into a developing device. When the toner in the toner hopper is used up, it has to be replenished.

Figure 9:
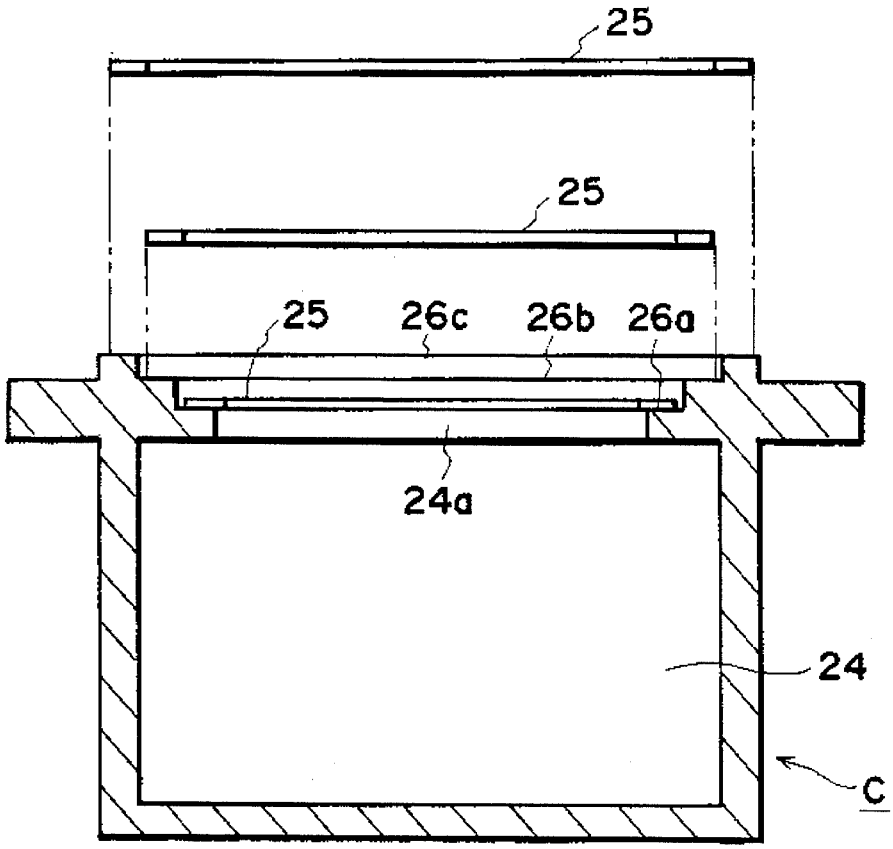
FIG. 9 is a sectional view of the sealing structure in which an edge of the opening of the toner cartridge is stepped.

Upon the toner replenishment, as shown in FIG. 9, a toner cartridge C is used. For such a toner cartridge C, a sealing member 25 similar to the sealing member 21 as in the forgoing embodiments is fused by heat to seal the opening 24*a* of the container 24 containing the toner. By doing so, the moisture absorption or scattering of the toner in the container 24, can be prevented. Upon replenishment of the toner into the main assembly, the sealing member 25 is removed from the opening 24*a* by the operator to permit the toner is supplied into the toner hopper from the container 24.

Therefore, an edge of the opening 24*a* of the toner cartridge C, as shown in FIG. 9, is formed into steps as in Embodiment 1 to provide a plurality of sealing surfaces 26*a*, 26*b* and 26*c*. By doing so, similarly to the foregoing embodiments, the sealing member 25 can be fused by heat a plurality of times, thus permitting easy recycling.

Also in the case of the toner cartridge C, the structure is not limited to the stepped structure of the sealing surface, but the sealing area may be increased or decreased or made different depending on the number of seals as in Embodiment 2. Similarly to Embodiment 3, a rib may be formed, and upon the recycling, the rib may be partly cut out by a predetermined amount to permit the sealing member 25 to be fused by heat on the fresh surface.

Additionally, also in the case of the toner cartridge C, the structure for permitting easy discrimination of the number of uses as in the foregoing embodiments, the recycling operation is made further easier.

Other Embodiments

In the foregoing embodiments, the process cartridge B contains the toner container 13*a* in the top frame 15*a*, and the developing portion 13*b* is provided in the bottom frame 15*b* (so-called top-bottom separable type). However, the present invention is not limited to this type, but is applicable to a so-called left-right separable cartridge in which the toner container and the developing portion are in one frame, and the photosensitive drum and the cleaning means are in the other frame.

In the foregoing embodiments, the use is made with a sealing member having bonded integral cover film and tear tape, in which the cover film is torn by pulling the tear tape (so-called tear tape type). However, the sealing member is not limited to this type. For example, the tear tape, the cover film or the like may be directly fused on the sealing surface (so-called easy peel type). Thus, the sealing method for the opening may be, a so-called tear tape type, so-calls easy peel type or the like.

In the foregoing embodiments, the sealing member is mounted to the edge of the container opening, and is fused thereon. However, the heat fusing is not a limiting feature, but use of a bonding or adhesive material, high frequency fusing or ultrasonic wave fusing or the like are usable. The process cartridge B is usable for monochromatic color formation as described hereinbefore, but is also usable for multi-color (two color image formation, three color image formation or a full-color) image formation by using a plurality of developing means.

As for the developing method, a known two-component magnetic brush developing method, cascade developing method, touch-down developing method, cloud developing method or the like, are usable.

The electrophotographic photosensitive member has a photoconductive member which may be an amorphous silicon, amorphous selenium, zinc oxide, titanium oxide, organic photoconductor (OHP) or the like. The photosensitive member may be in the form of a drum, belt or another rotatable type or a sheet or the like. Usually, it is a drum or belt. In the case of the drum type photosensitive member, a photoconductive material is evaporated or applied and so on on an aluminum alloy or the like cylinder.

In the first embodiment, the charging means is in the form of so-called contact method. However, a known corona discharger having a tungsten wire, a metal shield of aluminum or the like at three sides, wherein a high voltage is applied to the tungsten wire, so that positive or negative ions to the surface of the photosensitive drum to uniformly charge it.

As for the charging means, in addition to the roller type, examples of usable type includes a blade type (charging blade), pad type, block type, rod type, wire type or the like.

As for the method of cleaning to remove the residual toner from the photosensitive drum, fur brush or magnetic brush or the like is usable.

The process cartridge described hereinbefore comprises an image bearing member such as an electrophotographic photosensitive member or the like and at least one process means. More particularly, the process cartridge may contain an image bearing member and charging means as a unit into a cartridge detachably mountable to the main assembly, for example. In another example, an image bearing member and developing means are contained as a unit into a cartridge detachably mountable to the main assembly of the apparatus. In a further example, an image bearing member and cleaning means are contained as a unit into a cartridge detachably mountable to the main assembly. Even further example, it may contain an image bearing member and two or more of the process means as a unit into a cartridge which is detachably mountable to an image forming apparatus.

In the foregoing embodiments, the image forming apparatus has been described as an electrophotographic copying machine. However, the present invention is not limited to this, but is applicable to a laser beam printer, facsimile machine, a word processor or other image forming machines.

As described in the foregoing, according to the present invention, around an opening of a toner container, a sealing portion to be sealed by a sealing member a plurality of times, and therefore, the opening can be resealed by a fresh sealing member after the old sealing member is removed. By doing so, the used cartridge is reusable.

By the structure for permitting the easy discrimination of the number of sealing actions, the recycling operation for the cartridge is easy.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable to a main assembly of an image forming apparatus, said process cartridge comprising:

an electrophotographic photosensitive member;

process means actable on said photosensitive member;

a toner cartridge for containing toner for developing a latent image formed on said electrophotographic photosensitive member, said toner container having an opening for permitting a supply of the toner to a developing portion therefrom;

a sealing member for sealing the opening; and a seal mounting portion having a stepped portion on which the sealing member is mountable.

2. A process cartridge according to claim 1, wherein said seal mounting portion includes stepped portion on each of which the sealing members are mountable.

3. A process cartridge according to claim 1, wherein said seal mounting portion includes a projection extended around the opening, the projection being partly removable, wherein after the mounted sealing member is removed, a surface of the projection is partly removed, and thereafter, a fresh one of the sealing member is mounted thereto.

4. A process cartridge according to claim 1, 2 or 3, wherein said sealing member is mounted onto said seal mounting portion by heat fusing, with adhesive material or with ultrasonic wave bonding.

5. A process cartridge according to claim 1, wherein said sealing member includes a cover film and a tear tape, wherein the cover tape is torn by pulling the tear tape to open the opening.

6. A process cartridge according to claim 1, wherein said process means includes charging means, developing means or cleaning means.

7. A process cartridge according to claim 1, wherein said process means includes at least one of said charging means, developing means and cleaning means.

8. A process cartridge according to claim 1, wherein said process means includes developing means.

9. A process cartridge detachably mountable to a main assembly of an image forming apparatus, comprising:

an electrophotographic photosensitive member;

charging means for charging said photosensitive member;

developing means for developing a latent image formed on said photosensitive member;

cleaning means for cleaning toner remaining on said photosensitive member;

a toner container for containing the toner for developing the latent image, said container having an opening for supplying the toner to said developing means therefrom;

toner contained in said toner container;

a sealing member for sealing the opening;

a seal mounting portion having stepped portions for permitting sealing member mounting a plurality of times, wherein the sealing member is heat-fused on the sealing member mounting portion.

10. A process cartridge according to claim 9, wherein said seal mounting portion comprises a stepped portion on each of which said sealing member is mountable.

11. A process cartridge according to claim 9, wherein said seal mounting portion comprises a projection extended around the opening, the projection being partly removable, wherein after the mounted sealing member is removed, a surface of the projection is partly removed, and thereafter, a fresh one of the sealing member is mounted thereto.

12. A process cartridge according to claim 9, wherein said sealing member is mounted onto said seal mounting portion by heat fusing, with adhesive material or with ultrasonic wave bonding.

13. A process cartridge according to claim 9, wherein said sealing member comprises cover film and a tear tape, wherein said cover film is torn by pulling said tear tape to open the opening.

14. A process cartridge according to claim 9, wherein said process means includes charging means, developing means or cleaning means.

15. A process cartridge according to claim 9, wherein said process means comprises at least one of said charging means, developing means and cleaning means.

16. A process cartridge according to claim 9, wherein said process .means comprises developing means.

17. An electrophotographic image forming apparatus for forming an image on a recording material, to which a process cartridge is detachably mountable, said image forming apparatus comprising:

mounting means for detachably mounting a process cartridge to a main assembly of an image forming apparatus including an electrophotographic photosensitive member; process means actable on said photosensitive member; a toner container for containing toner for developing a latent image formed on said electrophotographic photosensitive member, said toner container having an opening for permitting a supply of the toner to a developing portion therefrom; a sealing member for sealing the opening; and a seal mounting portion includes a stepped portion on which the sealing member is mountable;

transfer means for transferring, onto the recording material, the toner image formed on said photosensitive member in said process cartridge mounted on said mounting means; and feeding means for feeding the recording material.

18. An image forming apparatus for forming an image on a recording material, to which a process cartridge is detachably mountable, comprising:

mounting means for detachably mounting a process cartridge to a main assembly of an image forming apparatus including an electrophotographic photosensitive member; charging means for charging said photosensitive member; developing means for developing a latent image formed on said photosensitive member; cleaning means for cleaning toner remaining on said photosensitive member; a toner container for containing the toner for developing the latent image, said container having an opening for supplying the toner to said developing means therefrom; toner contained in said toner container; a sealing member for sealing the opening; a seal mounting portion having stepped portions for permitting sealing member mounting a plurality of times, wherein the sealing member is heat-fused on the sealing member mounting portion;

transfer means for transferring, onto the recording material, the toner image formed on said photosensitive member in said process cartridge mounted on said mounting means; and feeding means for feeding the recording material.

19. An apparatus according to claim 18, wherein said image forming apparatus is an electrophotographic copying machine.

20. An apparatus according to claim 18, wherein said image forming apparatus is a laser beam printer.

21. An apparatus according to claim 18, wherein said image forming apparatus is a facsimile machine.

22. A toner cartridge for supplying toner to an electrophotographic image forming apparatus for forming an image on a recording material by developing a latent image formed on an electrophotographic photosensitive member into a toner image and by transferring the toner image onto the recording material, comprising:

a toner containing portion for containing the toner, the toner containing portion having an opening for supplying the toner to said electrophotographic image forming apparatus;

a sealing member for sealing the opening; and a seal mounting portion for permitting sealing member mounting a plurality of times, wherein said seal mounting portion comprises a stepped portion on which the sealing member is mountable.

23. A toner cartridge for supplying toner to an electrophotographic image forming apparatus for forming an image on a recording material by developing a latent image formed on an electrophotographic photosensitive member into a toner image and by transferring the toner image onto the recording material, comprising:

a toner containing portion for containing the toner, the toner containing portion having an opening for supplying the toner to said electrophotographic image forming apparatus;

a sealing member for sealing the opening; and a seal mounting portion for permitting sealing member mounting a plurality of times, wherein said seal mounting portion comprises a projection extended around the opening, the projection being partly removable, wherein after the mounted sealing member is removed, a surface of the projection is partly removed, and thereafter, a fresh one of the sealing member is mounted thereto.

24. A process cartridge according to claim 22 or 23, wherein said sealing member is mounted onto said seal mounting portion by heat fusing, with adhesive material or with ultrasonic wave bonding.

25. A toner cartridge according to claim 22 or 23, wherein said sealing member includes a cover film and a tear tape, wherein the cover tape is torn by pulling the tear tape to open the opening.

26. An image forming apparatus for forming an image on a recording material by developing a latent image formed on an electrophotographic photosensitive member into a toner image and by transferring the toner image onto the recording material, said image forming apparatus comprising:

a toner containing portion for containing the toner, the toner containing portion having an opening for supplying the toner to the electrophotographic photosensitive member;

a sealing member for sealing the opening; and a seal mounting portion for permitting sealing member mounting a plurality of times, wherein said seal mounting portion includes a stepped portion on which the sealing member is mountable.

27. An image forming apparatus for forming an image on a recording material by developing a latent image formed on an electrophotographic photosensitive member into a toner image and by transferring the toner image onto the recording material, said image forming apparatus comprising:

a toner containing portion for containing the toner, the toner containing portion having an opening for supplying the toner to said electrophotographic image forming apparatus;

a sealing member for sealing the opening; and a seal mounting portion for permitting sealing member mounting a plurality of times, wherein said seal mounting portion includes a projection extended around the opening, the projection being partly removable, wherein after the mounted sealing member is removed, a surface of the projection is partly removed, and thereafter, a fresh one of the sealing member is mounted thereto.

* * * * *

UNITED STATES PATENT AND TRADEMARK OFFICE

CERTIFICATE OF CORRECTION

PATENT NO. : 5,585,902 Page 1 of 3

DATED : December 17, 1996

INVENTOR(S) : TSUTOMU NISHIUWATOKO, ET AL.

It is certified that error appears in the above-indentified patent and that said Letters Patent is hereby corrected as shown below:

ON THE COVER PAGE

Under item [56], "FOREIGN PATENT DOCUMENTS":

"4293066 10/1992 Japan" should read --4-293066 10/1992 Japan--.

COLUMN 2:

Line 10, "yet" should read --yet a--.

COLUMN 6:

Line 15, "exceeds to use limit," should read --exceed their useful limit--;
Line 21, "use" should read --uses--;
Line 30, "made" should read --make--;
Line 53, "is" should read --are--; and
Line 61, "FIG. 7," should read --FIGS. 7(a) and 7(b),--.

UNITED STATES PATENT AND TRADEMARK OFFICE

CERTIFICATE OF CORRECTION

PATENT NO. : 5,585,902

DATED : December 17, 1996

INVENTOR(S) : TSUTOMU NISHIUWATOKO, ET AL.

It is certified that error appears in the above-indentified patent and that said Letters Patent is hereby corrected as shown below:

COLUMN 8:

Line 42, "so-calls" should read --so-called--.

COLUMN 9:

Lines 4-6, "so that positive or negative ions to the surface of the photosensitive drum to uniformly charge it." should read --may be used so that positive or negative ions uniformly change the surface of the photosensitive drum.--;

Line 9, "type includes" should read --types include--;

Line 12, "fur" should read --a fur--;

Line 25, "Even further" should read --In another--;

Line 37, "to be" should read --is--; and

Line 66, "portion" (second occurrence) should read --portions--.

UNITED STATES PATENT AND TRADEMARK OFFICE

CERTIFICATE OF CORRECTION

PATENT NO. : 5,585,902 Page 3 of 3

DATED : December 17, 1996

INVENTOR(S) : TSUTOMU NISHIUWATOKO, ET AL.

It is certified that error appears in the above-indentified patent and that said Letters Patent is hereby corrected as shown below:

COLUMN 10:

Line 36, "opening;" should read --opening; and--; and

Line 65, "process .means" should read --process means--.

COLUMN 12:

Line 22, "process" should read --toner--.

Signed and Sealed this

Eighth Day of July, 1997

Bruce Lehman

*Attest:*

BRUCE LEHMAN

*Attesting Officer*

*Commissioner of Patents and Trademarks*